United States Patent [19]

Park

[11] 4,369,955

[45] Jan. 25, 1983

[54] CUPOLA FURNACE SYSTEM

[76] Inventor: Ki D. Park, 1424-3 3Ku Sankyuk Dong, Buk-Ku, Taegu, Rep. of Korea

[21] Appl. No.: 205,306

[22] Filed: Nov. 10, 1980

[30] Foreign Application Priority Data

Jun. 25, 1980 [KR] Rep. of Korea ..... 80-2495

[51] Int. Cl.[3] ..... F27B 1/22

[52] U.S. Cl. ..... 266/139; 266/155; 266/219; 266/900; 75/43

[58] Field of Search ..... 266/900, 200, 155, 139, 266/219; 75/43, 44 RS

[56] References Cited

U.S. PATENT DOCUMENTS 1,476,106 12/1923 Rochlitz ..... 75/43
3,615,353 10/1971 Mahoney ..... 75/43
4,056,262 11/1977 Pollock et al. ..... 266/155

FOREIGN PATENT DOCUMENTS 1294927 11/1972 United Kingdom ..... 266/200

*Primary Examiner*—M. J. Andrews
*Attorney, Agent, or Firm*—John F. McClellan, Sr.

[57] ABSTRACT

A cupola system for production of gray iron employs otherwise wasted heat to preheat fuel, pig iron, flux and compressed air fed into a melting furnace, by diversion of melting furnace exhaust-gases through a preheating furnace containing feeding conduits for the fuel, pig iron and flux, and for the compressed air; the preheating furnace is laterally inclined downwardly from a point of exhaust to a chimney, to the melting furnace; the diverting means includes a closed, downwardly concave reflecting top over the melting furnace, and the preheating furnace has a concave roof; an important provision of the invention is employment of a maximum number of conventional size and shape tuyeres in a radial array in the melting furnace.

5 Claims, 6 Drawing Figures

OLD ART

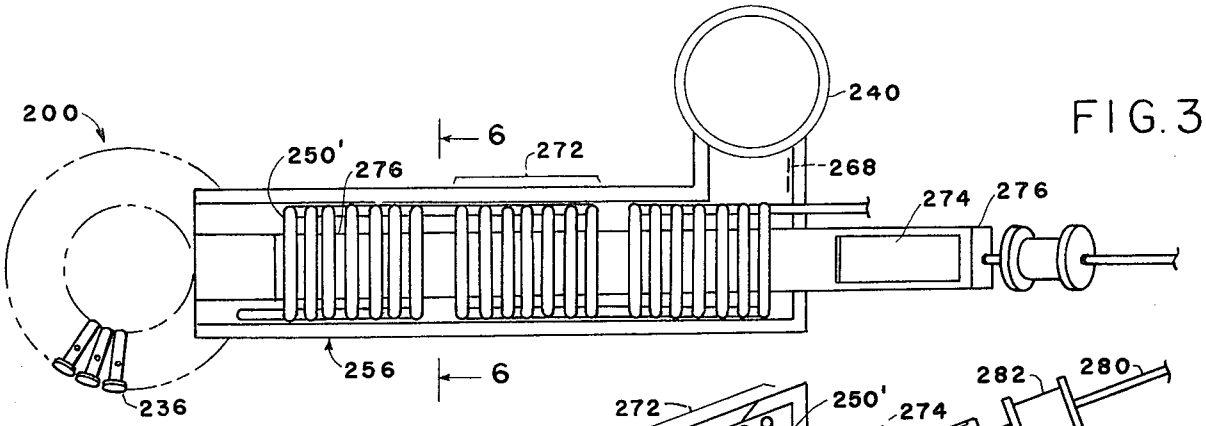
FIG. 3
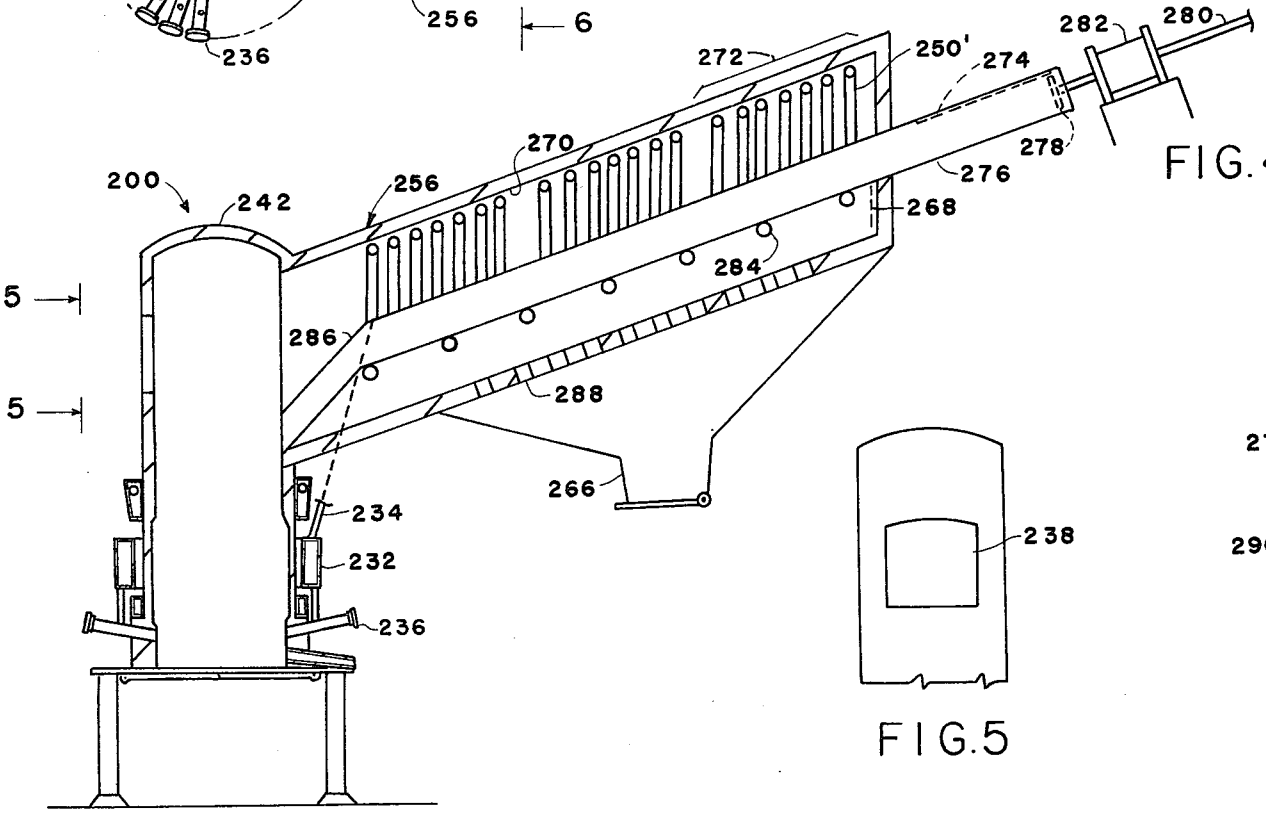
FIG. 4
FIG. 5
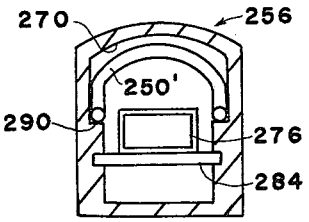
FIG. 6

CUPOLA FURNACE SYSTEM

This invention relates generally to furnace systems and specifically to cupola furnace systems for melting pig iton for castings and the like.

BACKGROUND OF THE INVENTION

The cupola affords one of the most economical means of melting metal, especially gray iron, because of the direct contact between metal and fuel, with the accompanying high rate of heat absorption, and is in use world-wide for the purpose.

A principle object of this invention is to provide an improved cupola system which increases efficiency by a significant amount, lowers power costs by 50%, and lowers fuel costs by 20% to 30%.

Further objects are to provide a system as described which can employ more compressed air, more uniformly distributed through the charge of fuel, than previous designs.

Other objects are to provide a system as described which reduces pollution below that of current designs, which produces a higher quality product, which is more durable, safer, and which is simple and economical to construct.

Still another object is to provide a system as described which has been built and tested in production, and which has proved satisfactory in all respects for widespread adoption as a new standard of the industry.

BRIEF SUMMARY OF THE INVENTION

In brief summary, given as cursive description only and not as limitation, the invention includes a cupola system which with otherwise wasted heat preheats both the compressed charging air and the metal and fuel charges by means of cupola exhaust-gas diversion through preheating furnace laterally inclined from the cupola and containing charging air and charging fuel and metal passages within it, and which preferably has a reverberatory furnace type roof; preferably also the system has the maximum number of tuyeres that can be packed together for radially inward discharge.

BRIEF DESCRIPTION OF THE DRAWING FIGURES

The above and other objects and advantages of this invention will become more readily apparent on examination of the following description, including the drawings, in which like characters refer to like parts:

FIG. 3 is a sectional plan diagram of the invention taken just above the tuyeres in FIG. 4 and the upward and laterally, removing the overhead of the inclined structure;

FIG. 4 is an elevational diagram of the invention, partly in section;

FIG. 5 is a detail taken at 5—5, FIG. 4; and

FIG. 6 is a sectional detail adapted from 6—6, FIG. 2.

DETAILED DESCRIPTION OF THE DRAWING FIGURES

Figure 1:
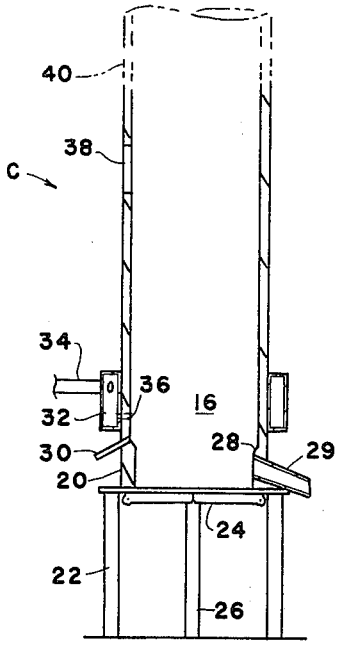
FIG. 1 is an elevational, partly sectional diagram of an old art cupola.

FIG. 1 diagrams a typical old-art cupola C, having a melting chamber 16 defined generally by a cylindrical shell 20 supported on legs 22 and extending up is a melting furnace and stack from bottom doors 24 which are held closed by a center prop 26 and usually are covered with packed sand, past a breast or clay-lined region 28 which may be pierced to draw off molten metal at a metal spout 29, upwardly of which may be a slag spout 30 then a circumferential wind-box 32 supplied by a line 34 with air from a compressor which is expelled through tuyeres 36 radially inward through the lowest layer of coke, heating the pig iron.

Charging with coke and pig-iron layers (and with limestone or other flux if desired) is done through one or more openings 38 in the stack 40 or wall of the shell above the melting furnace or charged portion. The stack extends straight up open to the sky to a relatively great height (many meters) relative to the typical shell diameter of about one meter.

Pre-heating of the air has been known, in a fuel-fired preheater typically.

In operation the stack expels quantities of very hot gases and cinders and ash straight up into the atmosphere; sizeable slag-like impurities can fall back into the molten metal as contaminants.

In details not otherwise specified as different, the present invention generally resembles the above type furnace.

Figure 2:
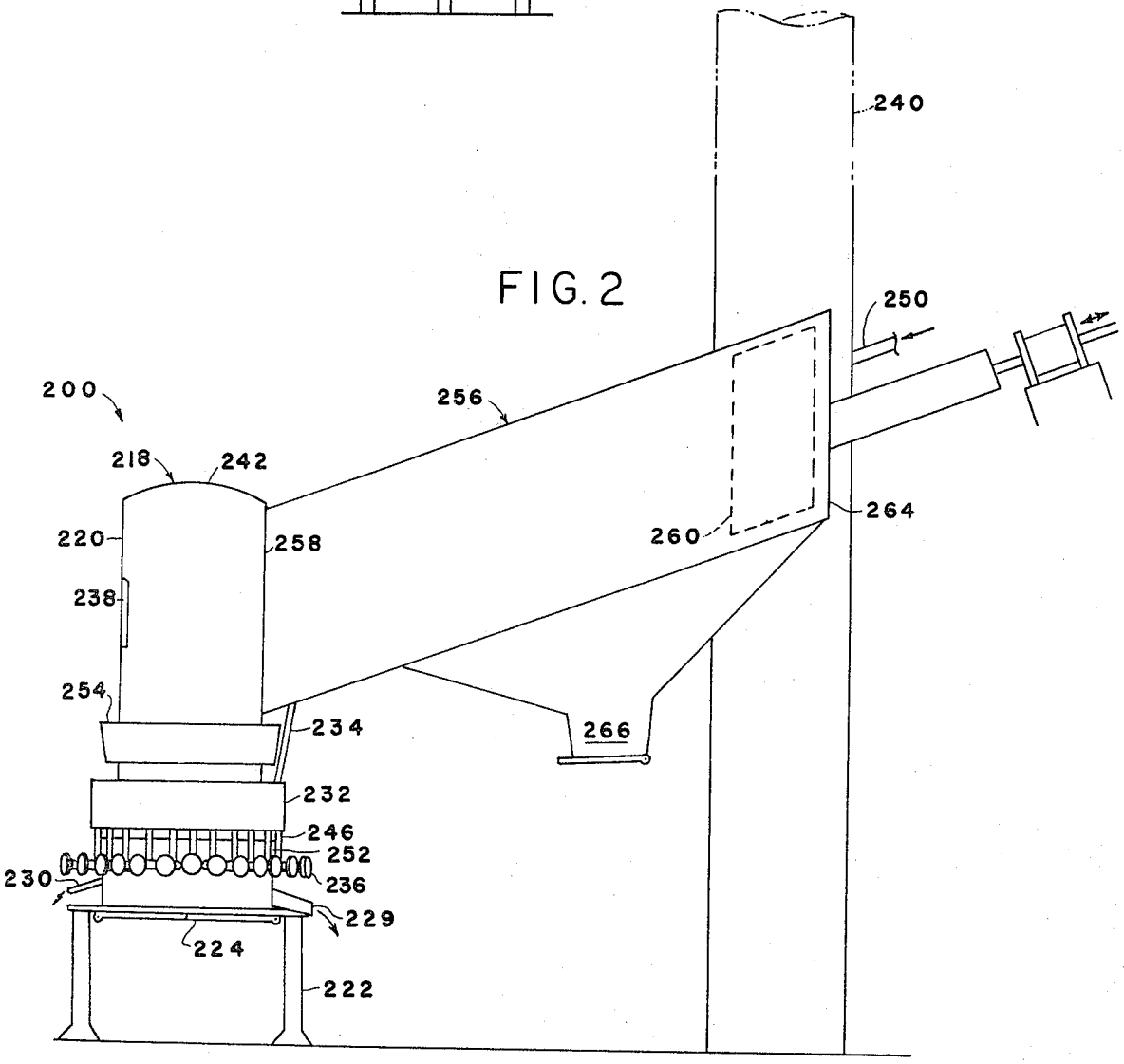
FIG. 2 is an elevational view of the exterior of the present invention.

FIG. 2 shows general exterior features of the present invention in embodiment 200 including cupola body or shell 220 which is the casing for the melting furnace 218, a short vertical cylinder supported on legs 222, closed at the bottom by conventional hinged doors 224, and closed at the top by an integral cover 242. The shell has near the bottom a conventional vent system with a spout 229 for flow of iron, and at a higher level a slag spout 230. Above this a plurality of radial tubes 236 with intake end portions, valved as indicated to adjust flow, the valve handles being shown, and with vents to the interior compressed air taken in through connections 246 with a circumferential wind box 232 which in turn is fed by a compressed air line 234 from above. The compressed air line receives compressed air from any suitable source (not shown) through inlet 250. Cooling water collars 252, 254 may be supplied around the shell above and below the wind box, and near the cover of the shell a typical opening or initial charging-gate or door 238 receives fuel and flux and pig iron when the system is cold, at the beginning of operation. The door also serves to control air in the system when desired.

Opposite the coke charging door a combinational charging tunnel and preheating furnace 256, hereinafter called the preheating furnace, extends at an angle from integral connection 258 with the shell 220, as an upward structure incline having a tubular cross-section to connection 260 through the side of the preheating furnace with vertical stack 240. The stack may safely stand on a proper foundation in this design, rather than weighting down the furnace. It may help support the other elements.

According to important advantages of this invention after the initial charge is laid and fired, all subsequent charging fuel and pig iron and flux are particularly efficiently pre-heated in the pre-heating furnace by otherwise wasted heat in gases and fumes expelled from the cupola body 220.

The pre-heating furnace has a closed upper end 264. Thus all gases and fumes and heat vented by the cupola or melting furnace are directed laterally through the preheating furnace before they can reach the stack.

Through the closed upper end 264 the fuel and metal and flux charges are passed by a feeding mechanism for preheat before reaching the melting furnace, as will be seen in reference to the next Figure.

An ash, cinder and slag funnel 266 depends from the bottom of the preheating furnace.

FIGS. 3 and 4 show interior details of the embodiment 200. The exterior walls of the system may be lined throughout with conventional refractory material, a fragment of which is indicated at 268.

Cover 242 over the melting furnace is of the reverberation type, downwardly axially concave, and reflects radiant heat back into the melting furnace, improving efficiency over conventional designs.

As stated, hot gases which are normally wasted in conventional designs of cupolas are put to work by this invention for preheating of the charging air and the charging metal. On upward passage from the melting furnace the gases are also exposed to conductive heating by the concave cover 242 and to heating by radiant heat reflected down in concentration by the concave cover. These superheated gases then pass through a vertical turn laterally into the preheating furnace 256, the overhead 270 of which is similar to a longitudinal parabolic trough and reflects heat downwardly.

Incoming compressed air for charging heats by gas and wall contact conduction and by radiant heating from the walls and the concave overhead as it passes through serially-related transversely deployed groups 272 of metal pipes 250' downward in this interconnected piping through the preheating furnace to connection with the windbox 232 through downpipe airline 234.

Pig iron charges are introduced at opening 274 which provides good downward-loading access. Incoming pig iron charges are heated by hot gases and by radiant heat from the preheating furnace concave overhead as they are thrust down to the melting furnace through metal chute 276, which may be closed on top and at the upper end, by conventional means such as chute-fitting thruster 278 on the end of a long screw 280 driven by a screw motor 282. Metal rods 284 fixed between walls inside the preheating furnace may be used to support the chute, and these further add to preheat transfer through it to the fuel and pig iron and flux.

It will be apparent that the relatively great input distance from the melting furnace may make the iron charging operation safer. Further, charging flexibility is preserved, the charging materials may be introduced as discrete batches, or the materials may be pre-mixed.

A further advantageous charging feature appears at the lower end of the straight inclined portion of the chute. The terminal length 286 of the chute drops away from the higher part at a relatively steeper angle which exceeds the angle of repose of the fuel and pig iron and terminates at the junction of the cupola shell and the preheating furnace. Down this relatively jam-free steeper length, which may be at a 45° angle, the preheated charge may eject by sliding and may impact and efficiently spread out from the center of the top part of the body of coke and iron in the melting furnace.

In use, twenty degrees upward incline from the horizontal of the preheating furnace has proved satisfactory.

It will be evident that the tortuous path the hot gases must traverse, including the two sharp turns, produces eddys which permit entrained ash and clinkers to drop out of the stream and fall through the plurality of perforations 288 in the bottom of the preheating furnace, where they are gathered in funnel 266 and can be put to use instead of polluting the atmosphere, and the ground and streams by fallout. Use of waste heat also produces cooler exhaust, and because it saves fuel, in the long run it produces less combustion by-products to pollute.

Still a further advantageous feature is evident in the plan detail; at the inner end, the tuyeres 236 are spaced by nothing but the walls of the refractory material or other conventional tubing or material of which they are made. This permits placing the absolute maximum number of a size in the exhaust-end plane, producing the best function and consequently the best product by more uniformly and efficiently burning out the carbon. This greater combustion efficiency also reduces pollution from incomplete combustion and increases the heat available in the preheating furnace.

FIG. 5 shows the relative size of the coke charging gate or door 238; when open this provides good access to and visibility of the preheating furnace as well as the charge area in the cupola.

FIG. 6 shows proportion, cross-sectional shape and relation of parts in the preheating furnace 256. Cross-sectional area is provided for passage of gases in the spaces on all sides of the pipes 250' and the chute 276, which passes down in the middle of the preheating furnace incline, except at the mounting contact points, which are minimal. It can be seen that net unobstructed cross-sectional area may be approximately the same as in the cupola shell.

Heating of the piping 250' may be enhanced by the transversely arcuate disposition nearly following the concavity of the overhead 270.

Conventional materials ae used throughout to assure low cost and reliability.

Construction is simplified by the rectangular sectional shapes of the preheating furnace, with the supportive wall ledges 290, and of the chute 276, and by the simple central mounting of the chute in the preheating furnace. These factors may also contribute to better preheating of the iron.

Further proportions of the unit may be as follows: height to base 1 meter; height from base to cover 3 meters; length of preheating furnace 5 to 20 meters; chute cross-section, 0.5 by 0.8 meters; preheating furnace cross-section; 1 by 1.5 meters.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by United States Letters Patent is:

1. In a system having: upright cupola cylindrical shell structure defining a melting chamber for melting pig iron by direct contact in a charge with burning fuel, means for charging pig iron and coke and flux into the melting chamber, means for charging compressed air into the burning fuel inwardly through the lower portion of the melting chamber, and an upright stack having connection for carrying away hot gases from said burning, the improvement comprising in combination: means for preheating said compressed air, pig iron, coke and flux to be charged into the melting chamber, including: a preheating furnace laterally connecting the upright cylindrical shell structure and upright stack, means for directing said hot gases through the preheating furnace, respective portions of the means for charging compressed air and of the means for charging pig iron, coke and flux passing through the preheating furnace for preheating said compressed air, pig iron, coke and flux, the means for directing comprising a cover closing the upper end of said cylindrical shell structure, the cover having a lower face in the form of a concave reflector coaxial with said cylindrical shell structure for concentrating heat reflected therefrom onto said charge in the melting chamber, the preheating furnace having overhead, bottom and sides rising in incline from an angle of the lower end at the cylindrical shell to a closed upper end proximate said stack, whereby said hot gases take a change in direction, and the preheating furnace venting to the stack on a said side of the preheating furnace and proximate said upper end.

2. In a system having: upright cupola cylindrical shell structure defining a melting chamber for melting pig iron by direct contact in a charge with burning fuel, means for charging pig iron and coke and flux into the melting chamber, means for charging compressed air into the burning fuel inwardly through the lower portion of the melting chamber, and an upright stack having connection for carrying away hot gases from said burning, the improvement comprising in combination: means for preheating said compressed air, pig iron, coke and flux to be charged into the melting chamber, including: a preheating furnace laterally connecting the upright cylindrical shell structure and upright stack, means for directing said hot gases through the preheating furnace, respective portions of the means for charging compressed air and of the means for charging pig iron, coke and flux passing through the preheating furnace for preheating said compressed air, pig iron, coke and flux, the means for directing comprising a cover closing the upper end of said cylindrical shell structure, the cover having a lower face in the form of a concave reflector coaxial with said cylindrical shell structure for concentrating heat reflected therefrom onto said charge in the melting chamber, the preheating furnace having overhead, bottom and sides rising in incline from an angle of the lower end at the cylindrical shell to a closed upper end proximate said stack, the means for charging pig iron, coke and flux comprising a chute extending from a loading location outside said upper end of the preheating furnace through said upper end generally along the middle of the incline of said preheating furnace and terminating in a length with a relatively steeper incline for slidably ejecting pig iron, coke and flux toward the top center of a said charge of pig iron and burning fuel in the melting chamber, and means supporting said chute in said preheating furnace with spaces on all sides of said chute for passage of preheating gases therearound.

3. In a system as recited in claim 2, means for urging pig iron, coke and flux down said chute including an elongate member and a motor for thrusting the elongate member along the chute, the chute having a generally rectangular cross-section, and said urging means having a portion fitting said generally rectangular cross-section.

4. In a system as recited in claim 2, said overhead of the preheating furnace being in the form of a downwardly concave trough for concentrating reflected heat onto said chute for better preheating pig iron therein, said means for charging compressed air including transversely deployed interconnected piping carrying compressed air through the preheating furnace, and said series of transversely deployed interconnected piping including a plurality of arcuate portions thereof generally conforming in curvature to said downwardly concave trough of the overhead of the preheating furnace and spaced therefrom.

5. In a system as recited in claim 2, said means for charging compressed air into the burning fuel including a plurality of radially deployed tubes having respective compressed air entrance ends and exhaust ends, said exhaust ends lying in a planar ring around the melting chamber, and means providing for disposition of a maximum number of said exhaust ends in said melting chamber, comprising each exhaust end being in contact on either side with a respective next adjacent exhaust end.

* * * * *